US005505301A

United States Patent [19]

Foley

[11] Patent Number: 5,505,301

[45] Date of Patent: Apr. 9, 1996

[54] TOOTHBRUSH CARRYING CASE

[75] Inventor: Kevin Foley, Kutztown, Pa.

[73] Assignee: Radius Inc., Kutztown, Pa.

[21] Appl. No.: 407,941

[22] Filed: Mar. 21, 1995

[51] Int. Cl.[6] ..... A45D 44/18

[52] U.S. Cl. ..... 206/362.2; 206/477; 206/823

[58] Field of Search ..... 132/308, 310; 206/209.1, 361, 362, 362.1, 362.2, 15.2, 581, 823, 362.3, 477, 478

[56] References Cited

U.S. PATENT DOCUMENTS

| | | | |
|---|---|---|---|
| 2,121,488 | 6/1938 | Nofz | 206/209.1 |
| 2,177,504 | 10/1939 | Thompson . | |
| 2,304,227 | 12/1942 | Zafarana . | |
| 2,725,270 | 11/1955 | Upchurch . | |
| 3,977,743 | 8/1976 | Harris . | |
| 4,396,238 | 8/1983 | Torruella . | |
| 5,052,556 | 10/1991 | Wilkinson | 206/362.2 |
| 5,095,924 | 3/1992 | Stanfield | 206/581 X |
| 5,215,193 | 6/1993 | Dennis | 206/581 X |
| 5,318,171 | 6/1994 | Szekely | 206/362 X |

*Primary Examiner*—Jacob K. Ackun
*Attorney, Agent, or Firm*—Darby & Darby

[57] ABSTRACT

A container for a toothbrush of the type having a head with bristles, a handle, and a connecting neck. The container comprises a body sized to contain the toothbrush. A securing clip is provided having two protruding arms. The arms are sized and shaped to frictionally engage a portion of the neck of the toothbrush. The container further includes means for selectively locking the securing clip to a portion of the body so that the toothbrush may be held in place within the container by the securing clip.

13 Claims, 3 Drawing Sheets

TOOTHBRUSH CARRYING CASE

FIELD OF THE INVENTION

The present invention generally relates to containers, and more particularly, relates to cases for carrying and holding toothbrushes.

BACKGROUND OF THE INVENTION

The fact that the toothbrush is a common article to take along during travel has led to a variety of carrying cases designed to carry one. Some of these carrying cases also function as the point-of-purchase packaging for a new toothbrush, and therefore do not require an additional box.

In some of the prior art carrying cases, provisions are offered to support a portion of the container or carrying case against a wall surface, for example, to function as a toothbrush holder between uses.

It is an object of the present invention to provide a carrying case assembly for a toothbrush which overcomes the deficiencies of the prior art.

It is another object of the present invention to provide a carrying case assembly which includes provisions for holding the toothbrush within the container and/or against a wall surface.

SUMMARY OF THE INVENTION

A container for a toothbrush of the type having a head with bristles, a handle, and a connecting neck. The container comprises a body sized to contain the toothbrush. A securing clip is provided having two protruding arms. The arms are sized and shaped to frictionally engage a portion of the neck of the toothbrush. The container further includes means for selectively locking the securing clip to a portion of the body of the container so that the toothbrush may be held in place within the body by the securing clip and so that the container can be secured against a wall surface.

BRIEF DESCRIPTION OF THE PREFERRED EMBODIMENT

DETAILED DESCRIPTION OF THE PREFERRED EMBODIMENT

Figure 1:
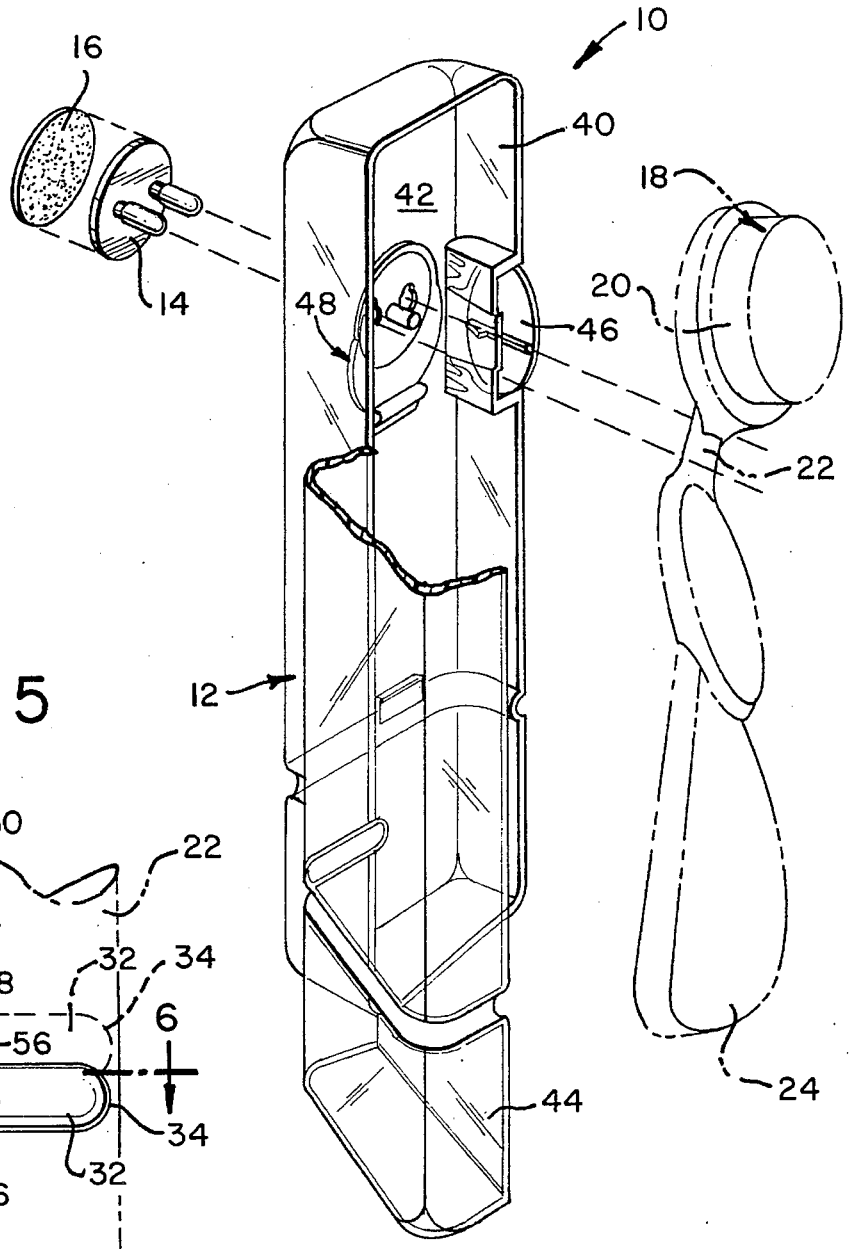
FIG. 1 is an exploded perspective view of the carrying case assembly of the preferred embodiment of the present invention showing a carrying case with parts broken away, a securing clip and a toothbrush.

Referring to FIG. 1, a carrying case assembly 10, in accordance with the present invention, includes a carrying case 12, a securing clip 14, an adhesive disc 16, and a toothbrush 18. Although the present invention may be employed with an appropriate carrying case adapted to carry any shape, size and type of toothbrush, it is particularly useful for ergonomic style toothbrushes, such as the ergonomic toothbrush described in U.S. Pat. No. 4,454,622 and U.S. Pat. No. Des. 277,141 which include relatively wide handle portions, or those toothbrushes which are otherwise unable to fit into the conventionally sized openings located on toothbrush holders commonly found integrally molded in medicine cabinets or wall mounted units in a bathroom. The carrying case 12 is shaped to snugly fit the particular shape of the toothbrush 18. The toothbrush 18 includes a head 20 having bristles, a neck 22 (preferably having a circular cross section) which connects the head 20 to a body or handle 24. The entire toothbrush 18 is typically integrally molded as a single unit (except for the bristles).

Figure 5:
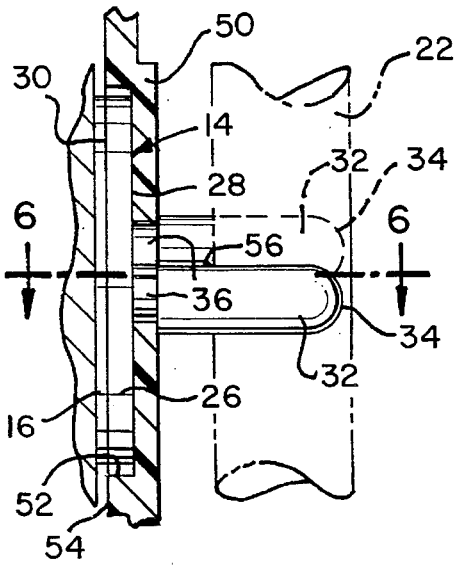
FIG. 5 is an enlarged side view of the securing clip, also showing a partial section of the carrying case.
Figure 6:
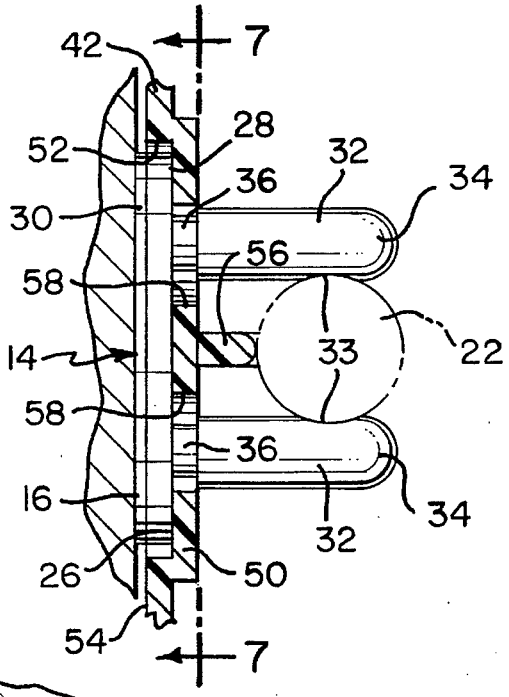
FIG. 6 is a horizontal sectional view of the carrying case assembly shown in FIG. 5, taken along the lines 6—6.

Referring to FIGS. 1, 4 and 5 and 6, the securing clip 14, in accordance with the invention, includes a circular backing plate 26 defining a front surface 28 and a rear securing surface 30. Two parallel arms 32 protrude substantially perpendicularly from the front surface 28 of the backing plate 26, each defining a respective central longitudinal axis (not shown). Each of the arms 32 preferably has a circular cross section of a first diameter ending in a rounded end 34 a predetermined distance from the backing plate 26. The arms 32 are located a predetermined distance from each other. Each of the arms 32 includes a circumferential locking channel 36 located adjacent to the front surface 28. Each of the channels 36 is circular in cross section, is of a smaller diameter than the arms 32, and is axially centered about each of the respective arms 32. The circumferential locking channels 36 preferably have an axial length substantially equal to the wall thickness of the carrying case 12, as shown in FIGS. 5 and 6. Located adjacent to the rounded ends 34 of each of the arms 32 is a cupped detent 33. The cupped detent 33 of each of the arms 32 face each other and together define an opening which is preferably slightly smaller in diameter than the diameter of the neck 22 of the toothbrush 18.

Figure 2:
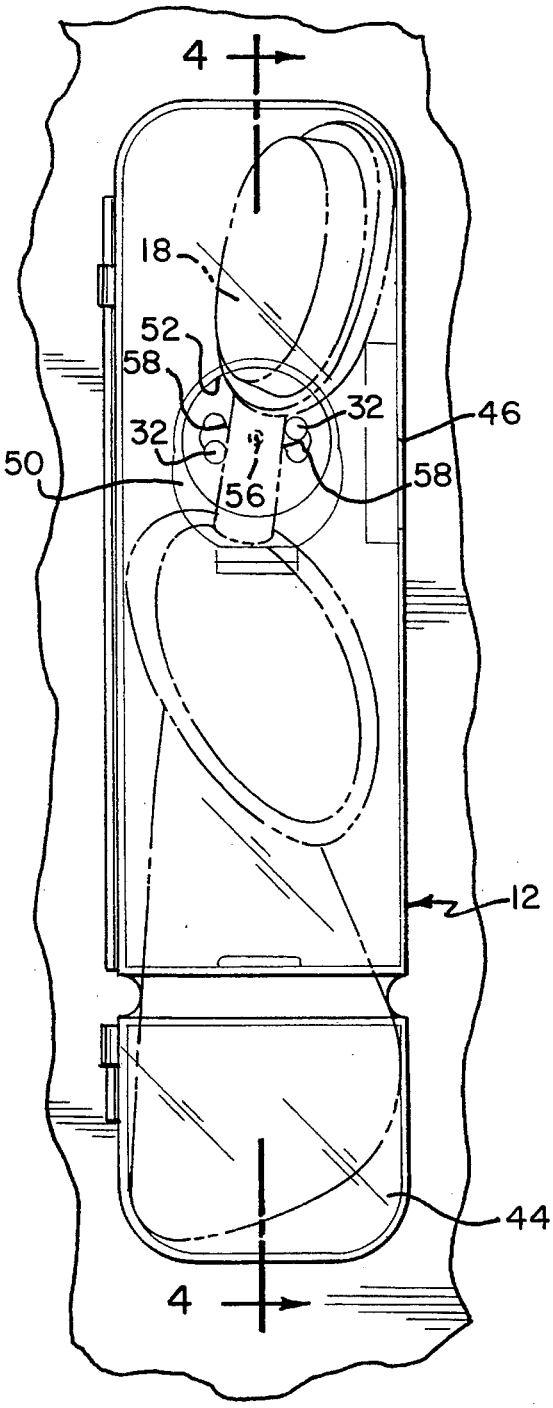
FIG. 2 is a front elevation view of the carrying case assembly of the present invention showing the carrying case supported on a wall surface.

The carrying case 12, as shown in FIGS. 1 and 2, and sectionally in FIGS. 4 through 7, preferably includes two elongated, generally rectangular, cupped sections; a container section 40 having a back wall 42, and a cover section 44. The two sections 40, 44 hingably mate together about an integral hinge along their length to form a generally rectangular shape when in a closed position, as shown in FIG. 2. The carrying case 12 may include any conventional clasp (not shown) to maintain the two sections 40, 44 in the closed position, and any appropriate lever mechanism 46 to assist in releasing the clasp and separating the two sections 40, 44 about the hinge, as shown in FIGS. 1 and 6.

As shown in FIGS. 1, 2, 5, 6, 7 and 8, the container section 40 of the carrying case 12 includes a clip receptor region 48 located at an upper portion of the back wall 42. The clip receptor region 48 includes a circular plateau section 50 which rises into the cavity of the container 40 from the back wall 42. The circular plateau section 50 forms a circular recessed section 52 at the same location of the back wall 42, but along a rear surface 54, as shown in FIGS. 5 and 6. The recessed section 52 is adapted to snugly receive the circular backing plate 26. The depth" of the recessed section 52 is preferably equal to the thickness of the backing plate 26 so that the backing plate 26 establishes a smooth aesthetically pleasing rear surface 54 when inserted into the clip receptor region 48, as shown in FIGS. 5 and 6.

The clip receptor region 48 further includes a post 56 which is centered about the circular plateau section 50, and protrudes generally perpendicularly into the cavity of the container 40, as shown in FIG. 6. The circular plateau section 50 includes two openings 58, located opposite each other equidistant from the post 56. Each of the openings 58 includes a first circular portion 60 which has a first diameter that is sized to snugly receive each respective arm 32 (see FIG. 8). Each circular portion 60 includes a center point which defines a radius and a centering circle 61 concentrically located about the post 56, as shown in dashed lines in FIG. 7. The openings 58 are arranged as shown in FIG. 6 to receive the two parallel arms 32 of the securing clip 14. Upper and lower curved locking sections 62 are located along the centering circle 61 (dashed lines in FIG. 6) and formed integrally with each respective opening 58. Each of the four curved locking sections 62 follow a radius which is adapted to snugly receive the circumferential locking channels 36 of each arm 32. Once the securing clip 14 is fully inserted into the recessed section 52, the circumferential locking channels 36 of each arm 32 will become generally coplanar with the curved locking sections 62 and the entire securing clip 14 may then be rotated either clockwise or counter clockwise (FIGS. 7 and 8) until a portion of each circumferential locking channel 36 engages with two (of the four) diametrically opposing curved locking sections 62. The arc degree of rotation required to engage the securing clip 14 into a locked position, as shown in FIG. 7, is very small, preferably no more than 5 arc degrees.

Once the securing clip 14 is secured (in the locked position) to the carrying case 12, the neck 22 of the toothbrush 18 may be received by the inwardly directed cupped detents 33 and held between the two parallel arms 32. The diameter of the neck 22 is preferably slightly greater than the greatest distance between the two cupped detents 33 (when at rest) so that the natural resiliency of the plastic used to make the securing clip 14 and the arms 32 create an inwardly directed spring bias which assists in frictionally engaging the neck 22 of the toothbrush 18.

Figure 3:
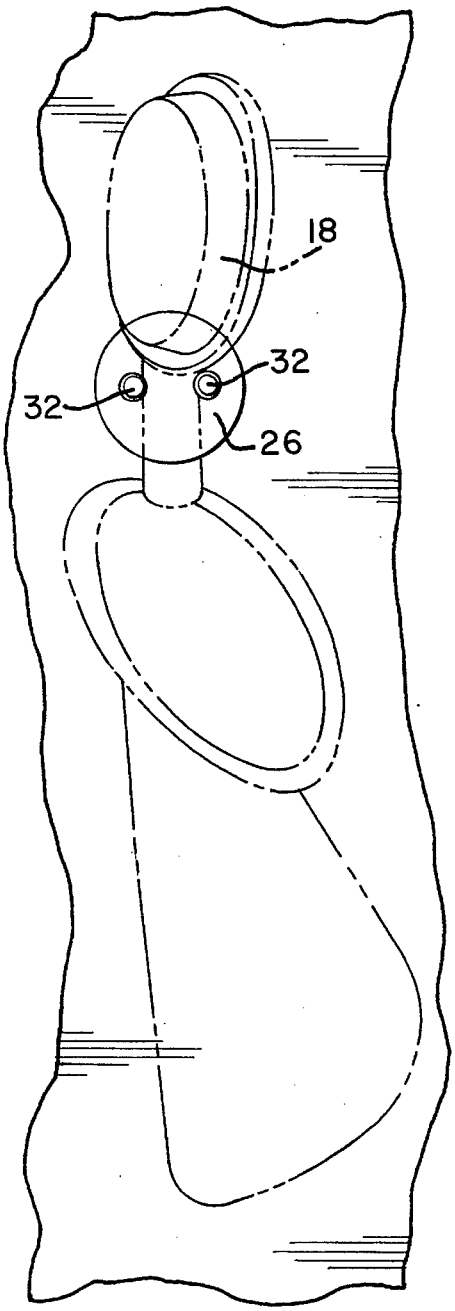
FIG. 3 is a front elevation view of the carrying case assembly of the present invention showing the securing clip mounted to a wall surface holding a toothbrush.
Figure 4:
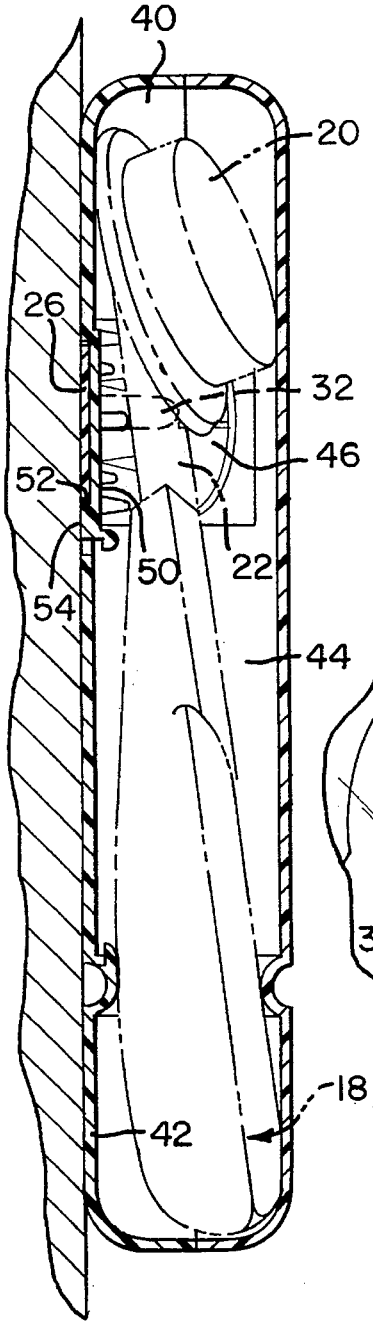
FIG. 4 is a vertical sectional view of the carrying case assembly shown in FIG. 2, taken along the lines 4—4.
Figure 7:
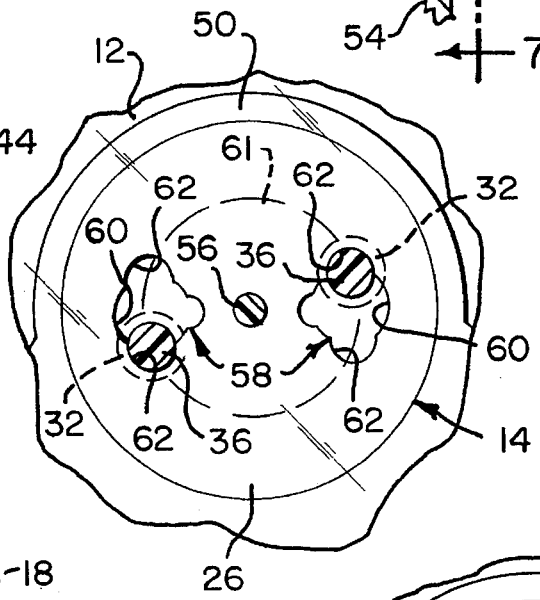
FIG. 7 is an enlarged detail view of a receptor portion of the carrying case, taken along the lines of 7—7 of FIG. 6.
Figure 8:
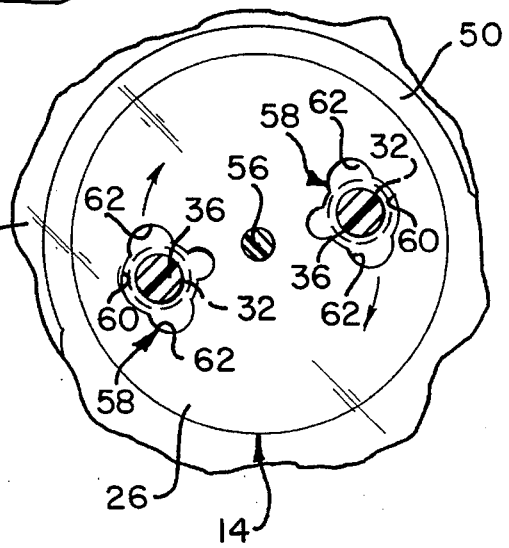
FIG. 8 is an enlarged detail view of the securing clip located in the receptor portion in the inserted position, in accordance with the invention.

The carrying case 12 preferably includes the securing clip 14 in its locked position, as shown in FIG. 7, at the point of purchase so that the toothbrush 18 is securely held within the carrying case 12. The adhesive disc 16 may be used after purchase to secure the rear securing surface 30 of the securing clip 14 to a vertical wall surface within the bathroom, for example. Thereafter, the consumer may either "clip" the neck 22 of the toothbrush 18 directly into engagement with the arms 32 of the now mounted securing clip 14, as shown in FIG. 3, or first "lock" the container section 40 of the carrying case 12 to the mounted securing clip 14, as described above, and then secure the neck 22 of the toothbrush 18 to the protruding arms 32 of the securing clip 14 within the carrying case 12, as shown in FIG. 2. In this later arrangement, the carrying case 12 functions as a miniature medicine cabinet for the single toothbrush 18. Of course, whenever desired the carrying case 12 may be removed from the securing clip 14 and simply used to carry the toothbrush 18 during travel, thereby functioning as a toothbrush carrying case.

What is claimed is:

1. A container for a toothbrush of the type having a head with bristles, a handle, and a connecting neck, said container comprising:

a body sized to contain said toothbrush;

a securing clip having two protruding arms being sized and shaped to frictionally engage around a portion of said neck of said toothbrush;

means for selectively locking said securing clip to a portion of said body so that said toothbrush may be held in place within said body by said securing clip.

2. The container according to claim 1, wherein said selective locking means includes two openings located within a wall portion of said body, each of said two openings being adapted to receive one of said two protruding arms.

3. The container according to claim 2, further comprising means for holding said two protruding arms within said respective two openings.

4. The container according to claim 3, wherein said holding means includes a circumferential channel located along a portion of at least one protruding arm, said channel being adapted to receive a portion of said body wall upon insertion of said at least one protruding arm into said opening.

5. The container according to claim 4, wherein said protruding arms are each generally circular in cross-section and both are formed integrally with said securing clip.

6. The container according to claim 5, wherein said securing clip with said integral protruding arms is made from a resilient plastic material.

7. The container according to claim 5, wherein said protruding arms are generally parallel to each other.

8. The container according to claim 1, wherein said securing clip includes a backing which has a rear surface that is generally perpendicular to said protruding arms.

9. The container according to claim 8, wherein said body includes a body surface having a recess which is located adjacent to said openings, said recess being sized and shaped to receive said backing of said securing clip so that said rear surface is generally coplanar with said body surface.

10. The container according to claim 1, wherein each protruding arm includes an inwardly directed detent which defines a locking area located between said two protruding arms, said locking area being generally shaped similar to the cross-sectional shape of said connecting neck of said toothbrush.

11. The container according to claim 8, further comprising means for attaching said rear surface of said backing to a vertical supporting surface.

12. The container according to claim 11, wherein said attaching means includes a double-sided tape adhesive.

13. A holder for holding a toothbrush to a vertical surface, said toothbrush being of the type having a head with bristles, a handle, and a connecting neck, said holder comprising:

a securing clip having a rear surface and a front surface;

means for attaching said rear surface of said securing plate to said vertical surface;

two generally parallel resilient arms protruding perpendicularly from said front surface, each of said arms including an inwardly directed detent, together said detents being sized and shaped to frictionally engage a portion of said connecting neck so that said toothbrush may be selectively secured to said holder;

a container sized and shaped to contain at least said head of said toothbrush; and means for selectively locking said container to said resilient arms.

* * * * *